US011773707B2

(12) United States Patent
Lonnes

(10) Patent No.: US 11,773,707 B2
(45) Date of Patent: Oct. 3, 2023

(54) METHODS AND SYSTEMS OF CREATING FRACTURES IN A SUBSURFACE FORMATION

(71) Applicant: ExxonMobil Technology and Engineering Company, Spring, TX (US)

(72) Inventor: Steve Lonnes, Spring, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 17/444,480

(22) Filed: Aug. 5, 2021

(65) Prior Publication Data

US 2022/0074295 A1 Mar. 10, 2022

Related U.S. Application Data

(60) Provisional application No. 63/076,447, filed on Sep. 10, 2020.

(51) Int. Cl.

| | |
|---|---|
| ***E21B 43/263*** | (2006.01) |
| ***E21B 43/267*** | (2006.01) |
| ***E21B 43/26*** | (2006.01) |

(52) U.S. Cl.

CPC ..... *E21B 43/267* (2013.01); *E21B 43/263* (2013.01); *E21B 43/2607* (2020.05)

(58) Field of Classification Search

None

See application file for complete search history.

(56) References Cited

U.S. PATENT DOCUMENTS

| | | | | |
|---|---|---|---|---|
| 3,593,793 | A * | 7/1971 | Kelseaux | E21B 43/263 166/299 |
| 4,220,205 | A * | 9/1980 | Coursen | E21B 43/263 166/308.1 |
| 5,346,015 | A * | 9/1994 | Grundmann | E21B 43/263 166/308.1 |
| 10,738,581 | B2 * | 8/2020 | Nguyen | E21B 43/263 |
| 2002/0007949 | A1 * | 1/2002 | Tolman | E21B 33/138 166/305.1 |
| 2003/0075326 | A1 * | 4/2003 | Ebinger | E21B 43/08 166/308.1 |
| 2006/0021753 | A1 * | 2/2006 | Wilkinson | E21B 43/26 166/308.1 |
| 2009/0151938 | A1 * | 6/2009 | Conkle | E21B 7/00 166/308.1 |
| 2011/0247816 | A1 * | 10/2011 | Carter, Jr. | E21B 43/26 166/298 |

(Continued)

FOREIGN PATENT DOCUMENTS

| | | | | |
|---|---|---|---|---|
| WO | WO 2019/027470 | * | 2/2019 | E21B 43/117 |
| WO | WO 2020/071918 | * | 4/2020 | E21B 47/06 |

*Primary Examiner* — Andrew Sue-Ako

(74) *Attorney, Agent, or Firm* — ExxonMobil Technology and Engineering Company—Law Department

(57) ABSTRACT

Methods and systems for creating fractures in rock are disclosed herein. In an exemplary method, reactive fluid is delivered into a wellbore. Formation fracture pressure is added to the reactive fluid in the wellbore sufficient to create a fracture network in a formation. The reaction pressure rubblizes the portion of a rock face of the fracture wall face to generate propping rubble that props the fracture open.

24 Claims, 12 Drawing Sheets

(56) References Cited

U.S. PATENT DOCUMENTS

| | | | | |
|---|---|---|---|---|
| 2011/0259584 | A1* | 10/2011 | Broussard, II | E21B 43/26 166/177.5 |
| 2019/0242231 | A1* | 8/2019 | Zhou | E21B 43/11852 |
| 2021/0148210 | A1* | 5/2021 | Nguyen | C09K 8/68 |
| 2021/0246782 | A1* | 8/2021 | Eng | E21B 49/081 |

* cited by examiner

100

200

300

300

300

300

400

500

600

700

800

900

METHODS AND SYSTEMS OF CREATING FRACTURES IN A SUBSURFACE FORMATION

CROSS-REFERENCE TO RELATED APPLICATIONS

This application claims the benefit of U.S. Provisional Application No. 63/076,447, filed Sep. 10, 2020, the disclosure of which is herein incorporated by reference in its entirety.

FIELD OF THE INVENTION

The present techniques relate generally to systems and methods for creating fractures in rock. More particularly, the present disclosure relates to systems and methods for using a reactive fluid that is activated to create pressure sufficient to create fractures in rock.

BACKGROUND OF THE INVENTION

The production of hydrocarbons, such as oil and gas, has been performed for many years. To produce these hydrocarbons, one or more wells in a field are drilled to a subsurface location which is generally referred to as a subterranean formation or basin. The process of producing hydrocarbons from the subsurface location typically involves various development phases, from a concept selection phase to a production phase. One of the phases involves creating fractures in rock or expanding pore networks in the rock to encourage high fluid conductivity. Creating these large highly fluid-conductive cracks is currently done by using a mixture of fluid and granular solids, referred to as proppant, pumped at high pressures though holes, called perforations, in the casing of a well. The mixture of fluid and proppant fractures the rock and fills the resulting crack with the proppant. These proppant-filled cracks and fractures provide the flow-conductive pathways for hydrocarbon fluids to exit the previously low-permeability rock and efficiently travel to the wellbore for retrieval.

Techniques described herein provide methods, systems, and apparatuses for creating fractures in rock. In unconventionally tight systems, the primary objective is to create cracks in hydrocarbon-bearing rock formations that have large surface areas. Another objective is high fluid conductivity that enables hydrocarbon fluids to efficiently flow from the low-permeability rock, through the crack, to the wellbore. Creating these large highly flow-conductive cracks is currently done by using a mixture of fluid and granular solids (e.g., proppant, pumped at high pressures though holes, called perforations), in a well's casing to fracture the rock and fill the resulting cracks with the proppant. These proppant-filled cracks/fractures provide the flow-conductive pathways for hydrocarbon fluids to exit the low-permeability rock and efficiently travel to the wellbore.

As a well is hydraulically fractured, the created fractures inherently open and crack in the easiest way possible based on the mechanical path of least resistance. One way to create a crack is by pushing the rock apart in the direction that has the lowest stress. Due to subsurface pressure, the lowest stress direction is in a vertical plane for a majority of unconventional wells. This is in part because it is hard for a void to form that may lift or support the vertical two miles of earth to create a horizontal fracture. Accordingly, fractures tend to form in vertical planes in a direction orthogonal to the formation's minimum stress direction. The fracture may be formed by increasing fluid pressure in a well up to and beyond the rock's tensile breaking strength, e.g., a fracture pressure. The fluid pressure in the well may be communicated to the rock through the perforation holes in the casing. The holes in the casing may be numbered between twelve (12) and twenty-four (24) holes and sized between ¾" to ½" in diameter.

To grow this fracture in height, length, and width in order to increase the fluid flow and porosity of a fracture network, a net pressure larger than the rock's minimum stress has to be delivered inside the fracture. One way of delivering this pressure is hydraulically. In an example, the injection fluid may be a mixture of rigid particles including a proppant similar in size to beach-sand. The fracturing fluid and proppant may have previously been mixed together on the surface into a slurry, referred to as "frac fluid," before being pumped into the well.

The net pressure, created by the pressure applied and commuted by the injection fluid, pushes the fracture open, and holds it open wide enough that the slurry's proppant can be efficiently pumped into the crack. The continued high-rate pumping creates a larger and larger fracture surface area as the edge of the fracture propagates deeper into the rock while also delivering the proppant farther and farther away from the wellbore. As the pumping operation ceases, the fluid filling the fracture slowly leaks off into the porosity of the rock, and the fracture gradually narrows in width until it comes to rest on the proppant that was injected into the fracture. The fracture area held open by proppant is typically referred to as the "propped area." The area of the fracture that was cracked by the fluid, but not held open by the proppant is typically referred to as the "wetted area." The propped area has much greater fluid flow capacity than the wetted area because of its higher fluid conductivity. This hydraulic fracturing practice is expensive and consumes significant volumes of fracturing materials. A large portion of the cost of unconventional wells is from the hydraulic fracturing operation. Hydraulic fracturing involves the cost of fracturing equipment combined with the cost of the consumables injected into the well, such as proppant, fluids, and chemicals.

SUMMARY OF THE INVENTION

Methods, systems, and apparatuses for optimizing tripping during a well construction phase are disclosed herein. An exemplary method for creating fractures in rock may include delivering reactive fluid into a wellbore, the reactive fluid to react to activation by generating a reaction pressure in the wellbore. In this method, a formation fracture pressure may be added to the reactive fluid in the wellbore, the formation fracture pressure sufficient to create a fracture in the wellbore. In an example, the method includes activating the reactive fluid to generate the reaction pressure as the reactive fluid has absorbed into a portion of rock of the fracture wall face, the reaction pressure rubblizing the portion of the rock of the fracture wall face to generate propping rubble that holds the fracture open. The method may also include maintaining a target pressure in the wellbore by controlling a pressure valve using surface bleed off, the target pressure within a wellbore structural integrity range.

Another embodiment provides a system for creating fractures in rock. In an example, the system includes a surface pump to deliver reactive fluid into a wellbore, the reactive fluid to react to activation by generating a reaction pressure in the wellbore. In this example system, the surface pump to add a formation fracture pressure to the reactive fluid in the wellbore, the formation fracture pressure sufficient to create a fracture in the wellbore. The system may include an activation source to activate the reactive fluid to generate the reaction pressure as the reactive fluid has absorbed into a portion of rock of the fracture wall face, the reaction pressure rubblizing the portion of the rock of the fracture wall face to generate propping rubble that holds the fracture open. The system may also include a pressure valve to maintain a target pressure in the wellbore using surface bleed off, the target pressure within a wellbore structural integrity range.

Another embodiment provides an apparatus for creating fractures in rock. The apparatus includes an activation source to activate a reactive fluid in a wellbore fracture to generate a reaction pressure, the activation to occur after the reactive fluid has absorbed into a portion of rock of the fracture wall face, the reaction pressure rubblizing the portion of the rock of the fracture wall face to generate propping rubble that holds the fracture open. The apparatus may include a pressure valve to maintain a target pressure in the wellbore using surface bleed off, the target pressure within a wellbore structural integrity range.

DESCRIPTION OF THE DRAWINGS

The advantages of the present techniques are better understood by referring to the following detailed n description and the attached drawings, in which.

Figure 1:
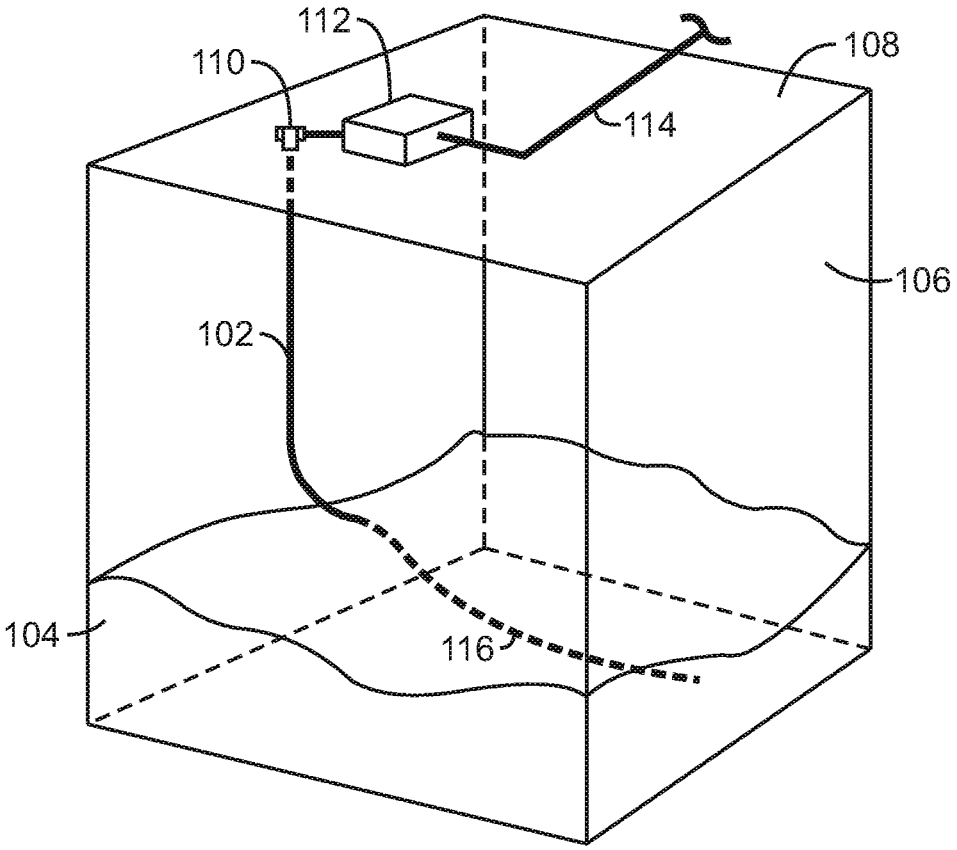
FIG. 1 is a diagram of a reservoir, in accordance with an exemplary embodiment of the present techniques.

For simplicity and clarity of illustration, elements shown in the drawings have not necessarily been drawn to scale. For example, the dimensions of some of the elements may be exaggerated relative to other elements for clarity. Further, where considered appropriate, reference numerals may be repeated among the drawings to indicate corresponding or analogous elements.

DETAILED DESCRIPTION OF THE INVENTION

In the following detailed description, a number of the presently disclosed techniques are described in connection with exemplary embodiments. However, to the extent that the following description is specific to a particular embodiment or a particular use of the present techniques, this is intended to be for exemplary purposes only. Accordingly, the present techniques are not limited to the specific embodiments described below, but rather, such techniques include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, "bleed off" means to equalize or relieve pressure from a vessel or system. At the conclusion of high-pressure tests or treatments, the pressure within the treatment lines and associated systems has to be bled off safely to enable subsequent phases of the operation to continue. The bleed off process has to be conducted with a high degree of control to avoid the effect of sudden depressurization, which may create shock forces and fluid-disposal hazards.

As used herein, a "choke" or "choke manifold" means a set of high-pressure valves and associated piping that usually includes at least two adjustable chokes, arranged such that one adjustable choke may be isolated and taken out of service for repair and refurbishment while well flow is directed through the other one.

As used herein, "collapse pressure" means the pressure at which a tube, or vessel, catastrophically deforms as a result of differential pressure acting from outside to inside of the vessel or tube.

As used herein, the term "fluid" refers to gases, liquids, and combinations of gases and liquids, as well as to combinations of gases and solids, and combinations of liquids and solids.

As used herein, "formation fracture pressure" means pressure above which injection of fluids causes the rock formation to fracture hydraulically.

As used herein, the noun use of "fracture" means a crack or surface of breakage within rock not related to foliation or cleavage in metamorphic rock along which there has been no movement. A fracture along which there has been displacement is a fault. As walls of a fracture have moved only normal to each other, the fracture is called a joint. Fractures can enhance permeability of rocks greatly by connecting pores together, and for that reason, fractures are induced mechanically in some reservoirs in order to boost hydrocarbon flow. Fractures may also be referred to as natural fractures to distinguish them from fractures induced as part of a reservoir stimulation or drilling operation. In some shale reservoirs, natural fractures improve production by enhancing effective permeability. In other cases, natural fractures can complicate reservoir stimulation.

As used herein, the verb "fracture" means to perform a stimulation treatment, which is routine for oil and gas wells in low-permeability reservoirs. Specially engineered fluids are pumped at high pressure and rate into the reservoir interval to be treated, causing a vertical fracture to open. The wings of the fracture extend away from the wellbore in opposing directions according to the natural stresses within the formation. Hydraulic fracturing creates high-conductivity communication with a large area of formation and bypasses any damage that may exist in the near-wellbore area.

As used herein, "fracture network" means patterns in multiple fractures that intersect with each other. Fractures are formed as rock is stressed or strained, as by the forces associated with plate-tectonic activity or reaction pressure from a fluid absorbed into the rock surface or adjacent to the rock surface reacting. As multiple fractures are propagated, they often form patterns that are referred to as fracture networks. Fracture networks may make an important contribution to both the storage, measured as porosity, and the fluid flow rates of formations, measured as porosity, permeability, or transmissibility. Fracture networks may include one or more of a single plane fracture, branched fractures, multiple fracture planes, or combinations thereof. Fracture network may include one or more fractures.

The term "hydraulic fracture" refers to a fracture at least partially propagated into a formation, wherein the fracture is created through the injection of pressurized fluids into the formation. The hydraulic fracture may be artificially held open by the injection of a proppant material. Moreover, the hydraulic fracture may be substantially horizontal in orientation, substantially vertical in orientation, or oriented along any other plane.

The term "hydraulic fracturing" (or "fracing") refers to a process for creating fractures that extend from the wellbore into reservoir formations so as to stimulate a potential for production. A fracturing fluid, typically viscous, is generally injected into the formation with sufficient pressure to create and extend a fracture, and a "proppant" is used to "prop" or hold open the created fracture after the hydraulic pressure used to generate the fracture has been released. As pumping of the treatment fluid is finished, the fracture "closes." Loss of fluid to permeable rock results in a reduction in fracture width until the proppant supports the fracture wall faces.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in natural gas, oil, or chemical processing facilities. Moreover, the term "hydrocarbon" may refer to components found in raw natural gas, such as $CH_4$, $C_2H_2$, $C_2H_4$, $C_2H_6$, $C_3$ isomers, $C_4$ isomers, benzene, and the like.

The term "matrix material" describes the material inside a porous network formed from a number of interconnected fractures. The term "matrix material" may also refer to the material in a fracture-face rock material including a number of pores that form a complex, interconnected volume enabling some fluid flow.

The term "permeability" refers to the connections between the spaces of rock grains of a formation, which may allow the fluids to move through the formation.

As used herein, "porosity" means the percentage of pore volume or void space, or that volume within rock that can contain fluids. Porosity can be a relic of deposition (primary porosity, such as space between grains that were not compacted together completely) or can develop through alteration of the rock (secondary porosity, such as feldspar grains or fossils that are preferentially dissolved from sandstones). Porosity can be generated by the development of fractures, in which case it is called fracture porosity. Effective porosity is the interconnected pore volume in a rock that contributes to fluid flow in a reservoir. It excludes isolated pores. Total porosity is the total void space in the rock whether or not it contributes to fluid flow. Thus, effective porosity is typically less than total porosity. Shale gas reservoirs tend to have relatively high porosity, but the alignment of platy grains, such as clays, makes their permeability very low.

As used herein, "pressure" means the force distributed over a surface, usually measured in pounds force per square inch, or $lbf/in.^2$, or psi, in U.S. oilfield units.

As used herein, "proppant" means particles mixed with fracturing fluid to hold fractures open after a hydraulic fracturing treatment.

As used herein, the term "reactive" refers to a property of a substance indicating it may undergo a chemical reaction that converts one chemical compound to another chemical compound with an associated release of energy. The rate-of-release of energy, the amount of energy released, and the chemical reaction activation approach associated with the reactive compound can be varied to create, e.g. the downhole requirements necessary to rubblize a fracture wall face. In an example, both detonation and deflagration fall within the domain of the term "reactive". A reaction could also take place slowly such that, for example, the resulting pressure build-up from the reaction in a pore space could be faster than the rate at which the pressure is released through the smaller pore throats, thus mechanically failing the rock matrix material.

As used herein, "readily reactive" describes a state of a reactive compound that permits an activation energy to be applied by an external source to initiate the reaction. Unless otherwise stated, a reactive fluid is deemed to be in a state that is readily reactive unless preconditioning of the compound is required to make it reactive. This preconditioning could be through a catalyst, heat, or other suitable techniques.

As used herein, the term "rubblize" refers to an action that turns a relatively solid rock surface into rubble.

As used herein, "tight" or "tight systems" describes a relatively impermeable reservoir rock from which hydrocarbon production is difficult. Reservoirs can be tight because of smaller grains or matrix between larger grains, or they might be tight because they consist predominantly of silt- or clay-sized grains, as is the case for shale reservoirs. Stimulation of tight formations can result in increased production from formations that previously may have been abandoned or produced uneconomically.

As used herein, a "tubular" means all forms of drill pipe, tubing, casing, drill collars, liners, and other tubulars for oilfield operations as are understood in the art. A tubular may also refer to a fluid conduit having an axial bore, and includes, but is not limited to, a riser, a casing, a production tubing, a liner, and any other type of wellbore tubular known to a person of ordinary skill in the art. In an example, a tubular refers to any structure that may be generally round, generally oval, or even generally elliptical. A tubular may also include any substantially flexible line, umbilical or a bundle thereof, that can include one or more hollow conduits for carrying fluids, hydraulic lines, electrical conductors or communications lines. These tubulars can also be collectively referred to as jumpers. The term tubular may be used in combination with joint to mean a single unitary length, or a stand meaning two or more interconnected joints.

As used herein, "wellbore" refers to the drilled hole or borehole, including the open hole or uncased portion of the well. Borehole may refer to the inside diameter of the wellbore wall, the rock face that bounds the drilled hole.

Overview

The present techniques provide for the creation of high flow-conductivity fractures within a wellbore without using proppant or large volumes of fluids. Specifically, instead of using traditional proppant, the present techniques use the rock within the wellbore to create its own proppant. This is done by using pressure released from an in-situ reactive fluid. The fluid is first hydraulically pumped into the wellbore to generate the pressures required to create a fracture. The reactive fluid may then be activated, the resulting pressure from the activated reactive fluid opening the fracture wide enough to accommodate proppant created by rubblizing the fracture wall face. Further, the reaction of the reactive fluid creates a rubblized zone including angular and irregularly shaped combinations of granules, particles, chunks, and blocks that create a fluidly interlocking, rubblized fracture network for formation fluid to flow from the formation, through the rubblized fracture network and to the wellbore. The rubble comprising the rubblized zone may vary in size from being more finely rubblized near the zone of reaction, with progressively larger particles away from the zone of reaction.

Conventional fracing practice requires large fluid volumes because a sufficient fracture width (e.g., a width of about ⅛" to ¼"), needs to be created to facilitate proppant delivery (e.g., to prevent the proppant bridging-off/packing-off the crack and plugging it as it flows out of the perforations and into the fracture). Using the present techniques permits the rock cracking operation to be completed using small volumes of fluid, reduced or no pumped proppant, and much less horsepower, e.g., one or two pump trucks as opposed to a fleet of pump trucks.

The present techniques may result in the use of significantly fewer consumables. Conventional hydraulic fracturing can use 5,000 to 10,000 barrels of fluid and 50,000 to 500,000 pounds of proppant to create a single fracture. The present techniques may not use any proppant and only use sufficient fluid to saturate the rock-face pore space at a fixed distance into the rock.

For example, it only takes 20 barrels of fluid to saturate ¼" of rock, (e.g., ¼" deep on both sides of a fracture), over a 50 foot high by 250 foot long planar region, assuming the planar region is symmetric on both sides of the wellbore, if the porosity of the rock is 10%. Again, in this instance, no proppant may be used.

These reductions result in significantly less equipment usage. For example, sand hoppers, blenders, fleets of water tanks, chemicals trucks, and conveyors may all be eliminated, and only 1 or 2 pumps may be used instead of 20 or more pumps. As a result, the equipment cost may be significantly lower.

Output Improvement

The present techniques additionally present the potential to create complex fractures and fracture networks, thus increasing the porosity of the rock. Benefits may also come from the potentially high net pressures available from the reaction process. As discussed above, fractures off of a lateral wellbore are typically created vertically and orthogonal to the direction of the lowest stress. However, if the net pressure in the fracture is high enough, it can potentially crack the rock in many directions. This provides the potential for a complex fracing pattern to be created, which ultimately results in better fluid flow rate and resource retrieval.

Using the present techniques reduces "screen-out" issues. In conventional fracturing, a "screen-out" occurs as the proppant bridges-off inside the fracture or at the perforations and prevents the fracing fluid from entering the fracture. As this happens, the well's pressure rises quickly, and the pumps need to be shut-off in the middle of the job. This causes the proppant in the fluid to settle-out in the wellbore. Expensive operations are required to clean out this settled proppant before fracturing operations can start up again as the piled proppant prevents pumping, perforating, and tool access. As the present techniques do not use pumped proppant, screen out may not be an issue.

As noted above, the present techniques also result in the creation of a larger number of fractures. As attempting to create multiple fractures simultaneously through multiple sets of perforations, perforation erosion combined with fracture-to-fracture internal stress communication, also called "stress shadowing," can cause one fracture to take more fluid than others, or a couple fractures to take all the fluid and the other fractures to screen-out as discussed above. This results in poorer access to the hydrocarbons because fewer fractures are placed in the well. The new approach may ensure that all perforations that required stimulation may be fractured and propped because the perforation erosion and stress shadowing mechanisms may be significantly reduced or eliminated.

The present techniques may reduce "pinch-out" issues. The new approach enhances the process by providing a mechanism to facilitate that the fracture is propped and packed all the way to the perforations. In conventional fracturing, the proppant is washed out of the fracture with clean fluid that is not otherwise carrying proppant. This clean fluid sweeps the proppant out of the wellbore so that operations with subsurface tools can take place uphole. As this proppant moves away, the fracture closes up, sometimes tightly, as the pressure is released. This non-propped region of the fracture restricts and inhibits hydrocarbon flow to the wellbore from the large propped area farther out in the formation. The present techniques do not wash out proppant and avoid a pinch out where all flow must pass through the near-wellbore region around the perforations to enter the well.

The present techniques provide better rock-to-fracture conductivity. An additional potential benefit comes from the lack of damage to the producing rock from the fracturing process. The fracing fluid used in conventional methods is forced in the pore-space of the fracture wall face rock. This fluid can negatively impact the flow performance of the rock by decreasing its relative permeability to hydrocarbons or water-blocking the pore space via capillary pressure driven forces.

Use of the present techniques may also result in increased wetted area fluid conductivity. The asperities and roughness created on the surface of the fracture wall face due to the unstructured removal of rock mass provides additional conductivity at a given location after closure even if the matrix debris and proppant fell deeper in the fracture due to gravity. This provides a fluid conductivity in the wetted, or non-propped, portion of the fracture that may be much greater than the fluid conductivity of the wetted area in a conventional fracture. Depending on the fracture's surface topography and roughness, the wetted area conductivity could potentially be higher than the propped area. The end result may be a larger effective fracture resulting in better production and better reservoir contact.

Impact Reduction

The present techniques may reduce the difficulty of flowback management. For example, after a traditional fracturing process is completed, there may be a large volume of chemically-modified fluids to handle. The present techniques may generate lower volumes of chemically-modified fluids, thereby reducing the cost and risk of handling or recycling such fluids. Additionally, the present techniques may simplify equipment logistics in the areas surrounding a drill site. For example, nearby local towns and cities may not experience the same number of service delivery trucks due to the reduction in the use of proppant and water in the present techniques.

Further, the present techniques may reduce the number of new drill sites that need to be identified as the presently-disclosed techniques could be readily repeated in the same drill sites if, after a period of time, the stimulation effectiveness was observed to decrease. A re-fracturing process could be done by using a straddle packer system conveyed by coiled tubing or a conventional drill pipe. This re-fracturing process could also potentially unlock new reserves by taking advantage of the stress reorientation that occurs in the formation as a result of the production-induced pressure depletion.

The present techniques may additionally enable effective fracture mapping without the use of additional invasive or bulky mapping procedures or equipment. For example, the large acoustic emissions from the shattering rock face could potentially be used in concert with micro-seismic measurements to map the fracture geometry. In another example, the fracing fluid's reactions could activate other mappable emission sources that could be used to spatially map the fracture geometry.

Description of Figures

FIG. 1 is a diagram of a reservoir, in accordance with an exemplary embodiment of the present techniques. The diagram 100 shows a well 102 that is drilled down to a reservoir 104 through an overburden 106. At the surface 108, a wellhead 110 can be connected to a facility 112 for processing produced fluids, for example, drying and compressing a natural gas prior to shipping the gas through a pipeline 114. The present techniques are not limited to a single well 102 or to hydrocarbon production as they may be used in other configurations and applications.

The well 102 can have multiple main wellbores 116 that branch off from the well 102 to drain other portions of the reservoir 104. Generally, if hydraulic fracturing is to be used, multiple branches increase the cost of completing a well 102, due to the cost of the fittings used at branch points 118. For example, the fittings must have sufficient strength to withstand the pressure used for creating fracture networks in rock by hydraulic fracturing with the reactive fluid. Thus, if hydraulic fracturing and branching is to be used, it may be more economical to drill a number of individual wells that have no branching than to place the high pressure fittings in a branched well. Accordingly, techniques for creating dense fracture networks through reactive fracturing, as described herein, may allow for depletion of a greater portion of a reservoir with a single well.

Figure 2:
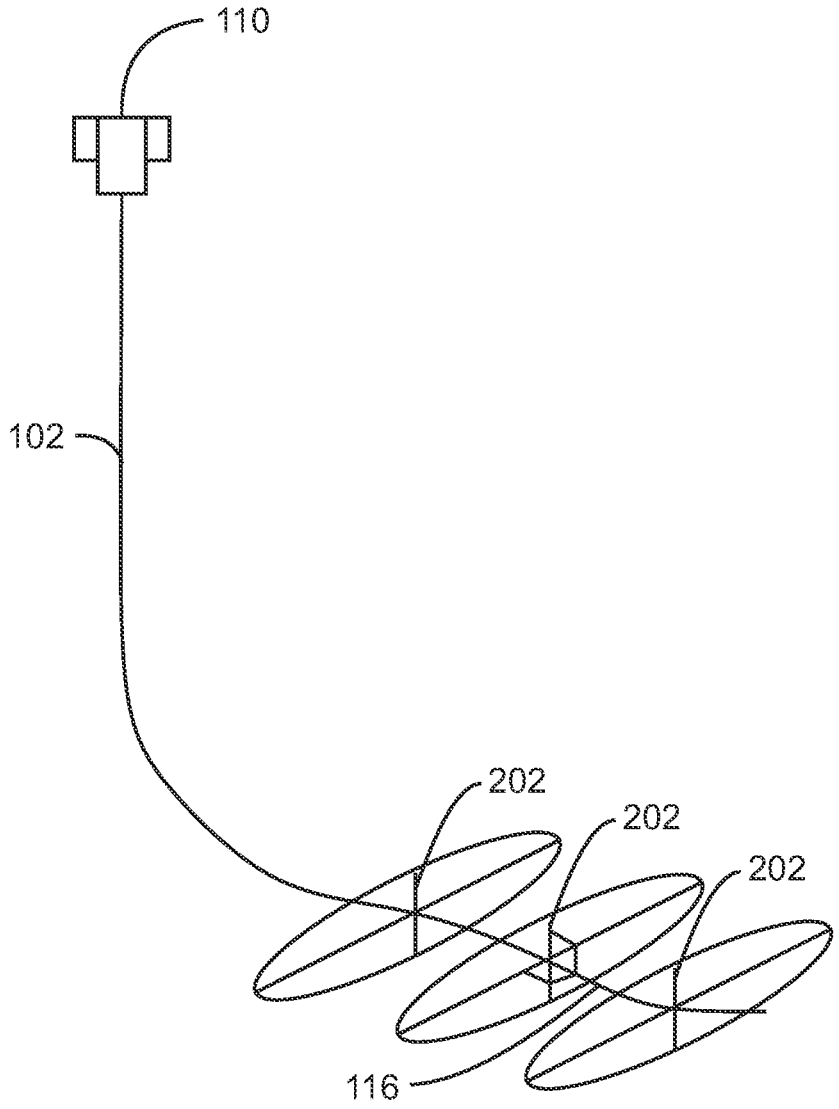
FIG. 2 is a top view of the reservoir, showing multiple lateral wellbores drilled off from each adjacent segment of a main wellbore, in accordance with an exemplary embodiment of the present techniques.
Figure 3A:
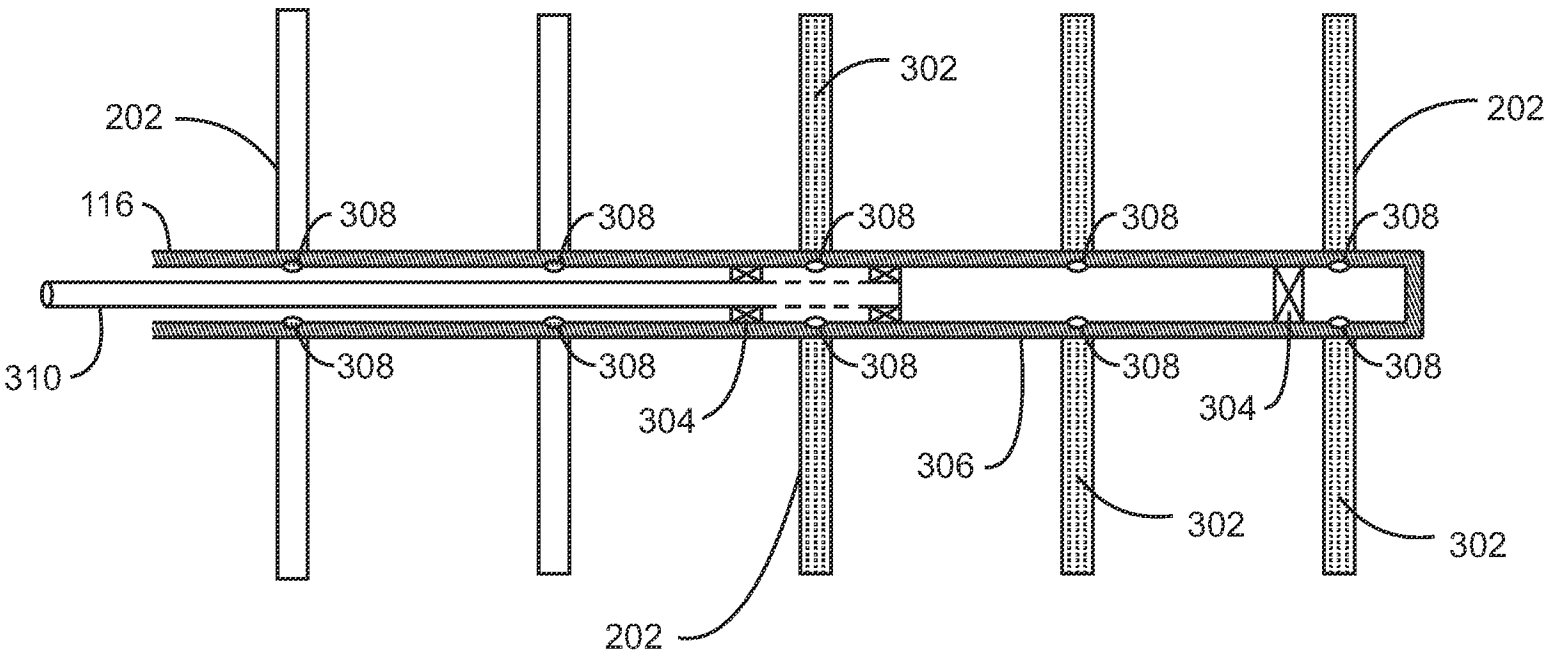
FIGS. 3A, 3B, 3C, and 3D are view of a main wellbore with a number of lateral wellbores showing a reactive fluid added to a number of the lateral wellbores, in accordance with exemplary embodiments of the present techniques.
Figure 3B:
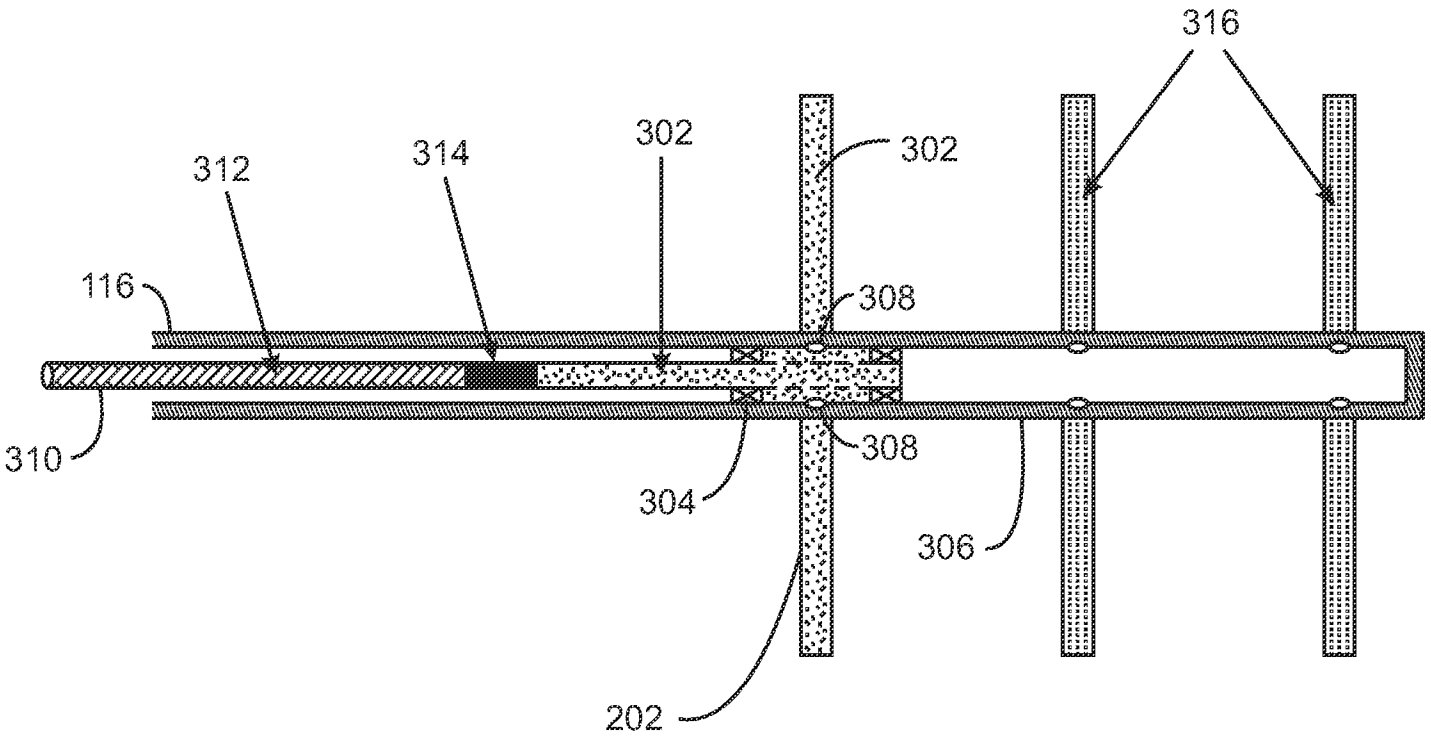
Figure 3C:
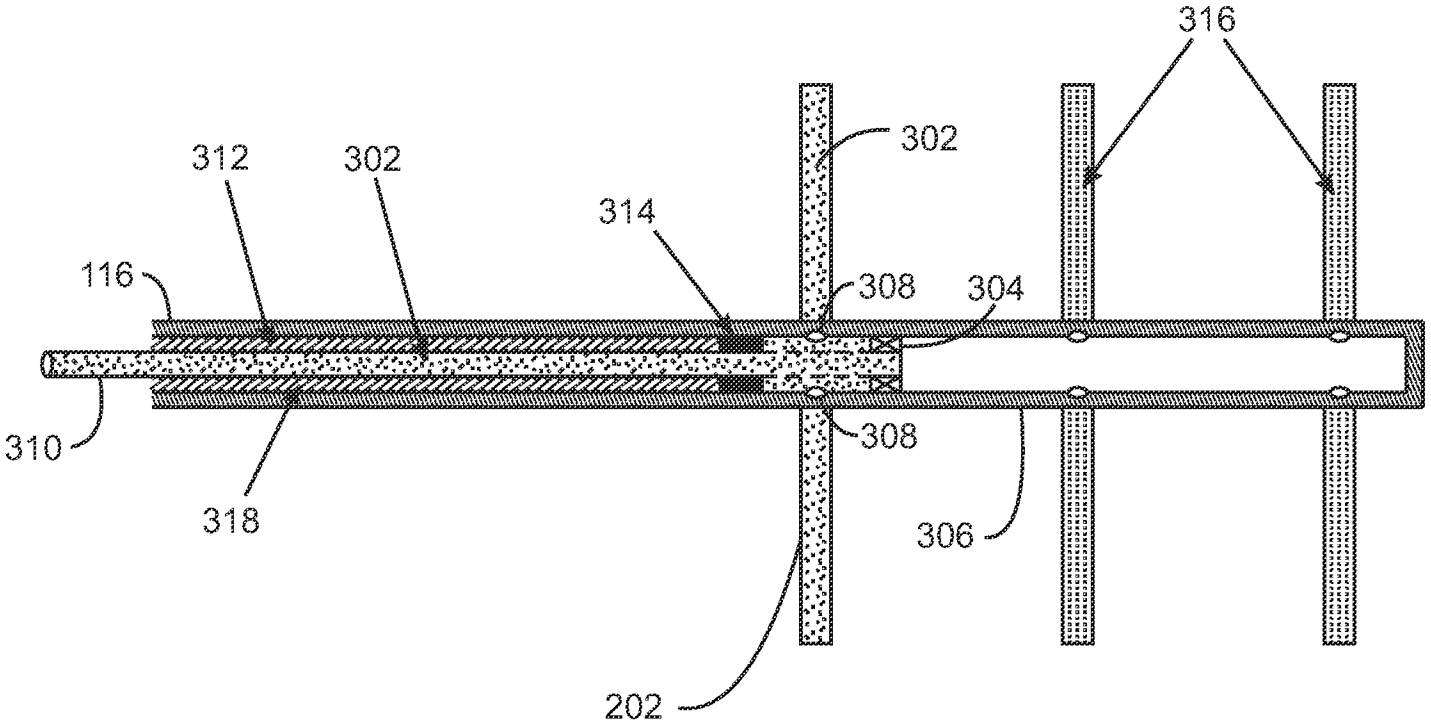
Figure 3D:
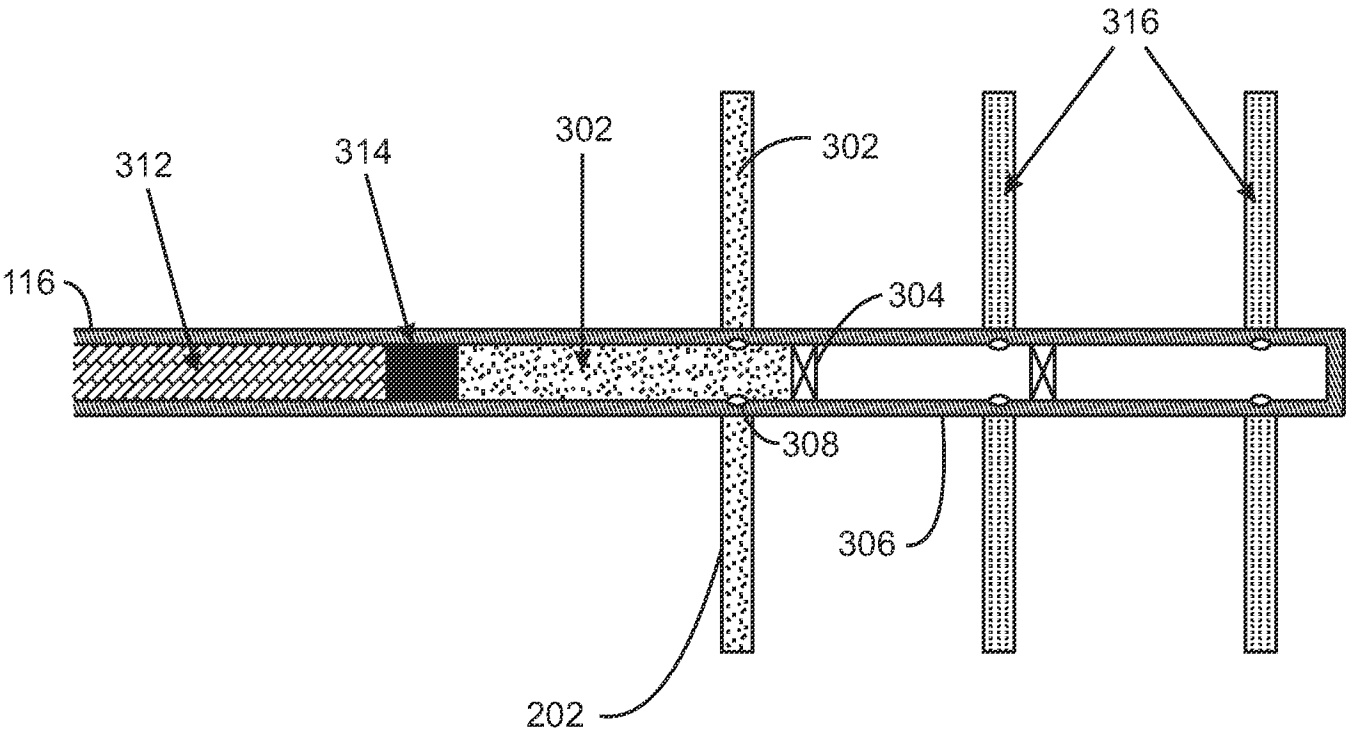

FIG. 2 is a top view 200 of the reservoir, showing multiple lateral wellbores drilled off from each adjacent segment of a main wellbore, in accordance with an exemplary embodiment of the present techniques. The top view 200 illustrates numerous lateral wellbores 202 that may be drilled from each of the main wellbores 116. The lateral wellbores 202 may be placed in a parallel array or staggered at different angles. Further, the lateral wellbores 202 can be vertical to the main wellbores 116. In other embodiments, the main wellbores 116 may be vertical, and the lateral wellbores 202 drilled out at in a substantially horizontal attitude. An arrangement of the main wellbores 116 and lateral wellbores 202 for a particular reservoir can be determined through advanced geomechanical modeling or experiments. In exemplary embodiments of the present techniques, the lateral wellbores 202 are substantially perpendicular to the main wellbores 116, after any curves made as drilling out from the main wellbore 116. In other words, a centerline of a lateral wellbore 202 at the opposite end of the lateral wellbore 202 from the main wellbore 116 can be substantially perpendicular to the main wellbore 116. In an exemplary embodiment of the present techniques, substantially perpendicular indicates that the centerline of the lateral wellbore 202, at the end of the lateral wellbore 202 opposite the main wellbore 116, is within a cone of about 30° around a perpendicular line drawn out from the main wellbore 116. Closer to the main wellbore 116, the lateral wellbore 202 may be at a lower angle, depending on the drilling techniques used to create the lateral wellbore 202.

The drilling of the lateral wellbores 202 may be performed using any number of techniques that can drill outward from the main wellbores 116, including, for example, coil tubing jet drilling or mechanical drilling. After the lateral wellbores 202 are drilled out from the main wellbores 116, reactive fluid may be pumped into the lateral wellbores 202. After the reactive fluid has been pumped in, it may be hydraulically pressurized to a formation fracture pressure to create fractures 204 along the one or more lateral wellbores. Fractures 204 that connect to a lateral wellbore 202 or across multiple lateral wellbores 202 may allow hydrocarbons or other produced fluids to flow to the lateral wellbores 202 and into the main wellbores 116 for production at the wellhead 110.

FIG. 3A-D are views 300 of a main wellbore 116 with a number of lateral wellbores 202, showing a reactive fluid 302 added to a number of the lateral wellbores 202, in accordance with an exemplary embodiment of the present techniques. In this top view 300, a number of lateral wellbores 202 extend from the main wellbore 116. However, the techniques are not limited to this configuration, as any number of other configurations may be identified by modeling or experiments. For example, although reactive fluid is shown located in only some of the lateral wellbores 202, reactive fluid 302 may be pumped into all of the lateral wellbores 202. In an example, the reactive fluid 302 may be reacted for one lateral wellbore 202 at a first time, and the reactive fluid 302 may be reacted for a second lateral wellbore 202 at a second time. In another embodiment, an activation source may activate the reactive fluid for the entire main wellbore 116 and all connected lateral wellbores 202 simultaneously.

Figure 4:
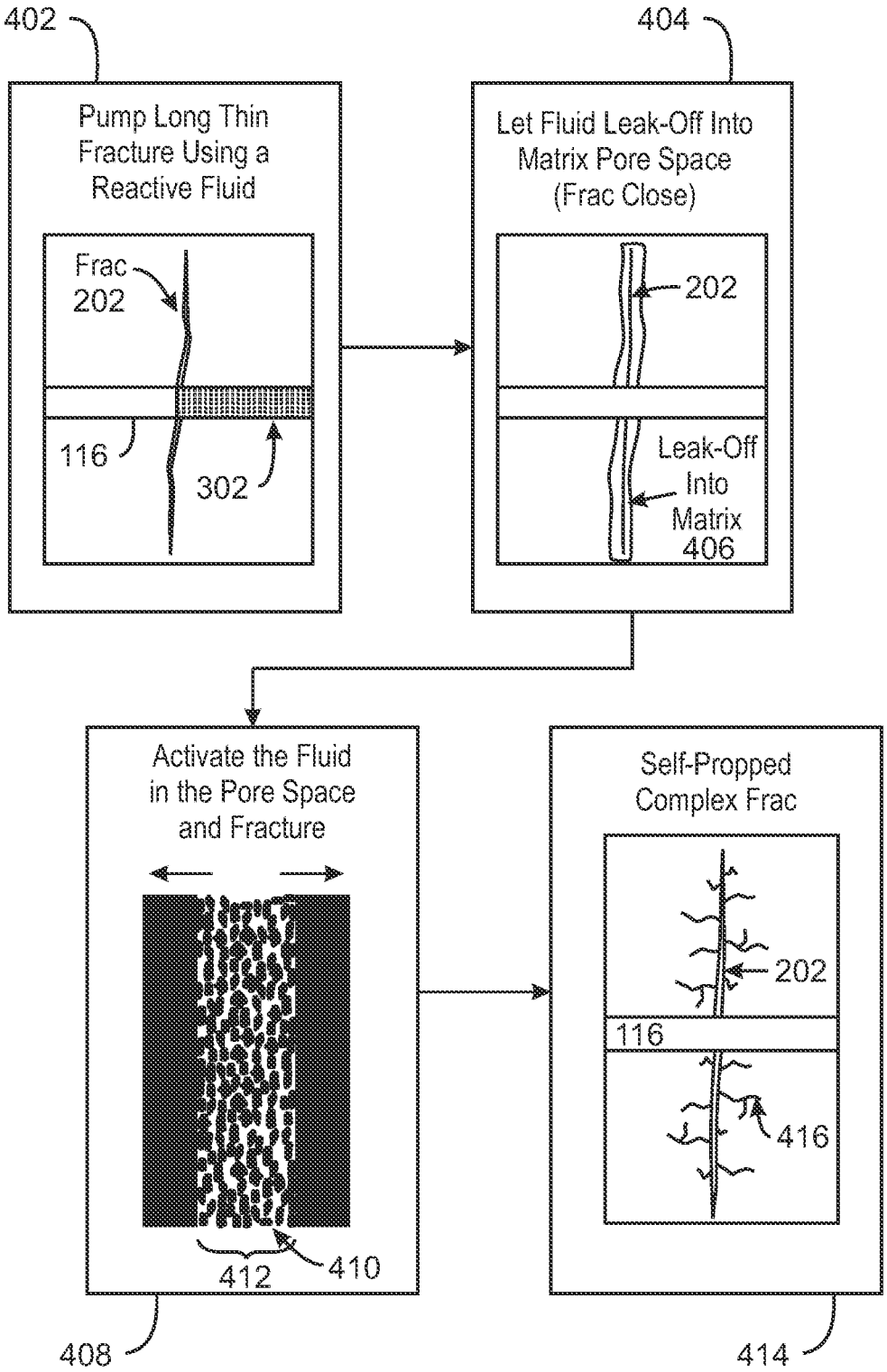
FIG. 4 is a schematic drawing for creating high flow-conductivity fractures without using proppant, in accordance with an exemplary embodiment of the present techniques.

FIG. 4 is a schematic drawing 400 for creating high flow-conductivity fractures without using proppant, in accordance with an exemplary embodiment of the present techniques. Like numbered items are as described in FIGS. 2 and 3.

The use of external proppant can increase the cost and complexity of a drilling operation. Accordingly, the present techniques provide examples where proppant is produced "in situ" or at the site of the fracture by rubblizing the fracture wall face. While some embodiments of the present techniques may use no externally-added proppant, other embodiments may use some external proppant in combination with the in-situ proppant generated by the present techniques. In these embodiments, less external proppant may be used as compared to conventional fracing operations due to the ability to also use in-situ proppant.

In FIG. 4, the first block 402 begins with a fracture 204 already created off of a lateral wellbore 202. In this first block 402, the reactive fluid 302 is pumped into the fracture 204. The reactive fluid 302 may more easily travel deeply into the fracture 204 compared to a fluid containing proppant. The reactive fluid 302 may be stable at surface conditions and may also be used to create the fracture 204 or additional fractures 204 by being pumped down the well at high pressure. The pumping of the reactive fluid 302 into the fracture 204 creates a thin open fluid-filled fracture in the rock.

In the second block 404, the pumping of the reactive fluid 302 into the fracture stops, and the fracture is allowed to leak off, or partially leak off, the reactive fluid, or absorb or stand adjacent into the porosity of the rock through the face of the fracture 204. This leak-off area 406 may include a matrix of micro-fractures or pores in the rock. The leak off in to the leak-off area 406 displaces the existing hydrocarbons in the pore space of the rock with the reactive fluid 302. In an example, the rock may not be absorbent, porous, or allow leak-off or permeation of reactive fluid. In such cases, the reactive fluid may be dispersed adjacent to the rock surface throughout the fracture network.

In the third block 408, a close up of the fracture is shown as the reactive fluid 302 is activated. The activated reactive fluid 302 causes an increase in pressure that opens the fracture 204 into an expanded fracture 412. The activated reactive fluid 302 causes the fracture wall face rock to rubblize, thereby generating rubble 410. In an example, the rubble 410 serves as proppant in the expanded fracture 412, thereby enabling the expanded fracture 412 to maintain some of its size. While the pressure inside the well increases due to the activation of the reactive fluid 302, the pressure inside the well is managed to ensure that well integrity is maintained. In an example, the pressure is managed using surface bleed-off. Once the reaction in the fracture 204 is completed, the pressure in the well and in the expanded fracture 412 is decreased in a controlled fashion, such as natural leak-off, such that the rubble 410 provides the proppant for the fracture 204 as it closes.

In the fourth block 414, the previously-expanded fracture 412 contracts onto the rubble 410. The resulting fracture channel is larger and more porous than prior to the activation of the reactive fluid 302. The fracture 204 may also be connected to newly-formed complex fractures 416 and micro-fractures created as the reactive fluid was activated. These complex fractures 416 may increase the porosity of the fracture. In addition, the complex fractures 416 may allow for greater access to the resources and increase the fluid flow rate from the fracture 204.

Method for Creating Fractures in Rock

Figure 5:
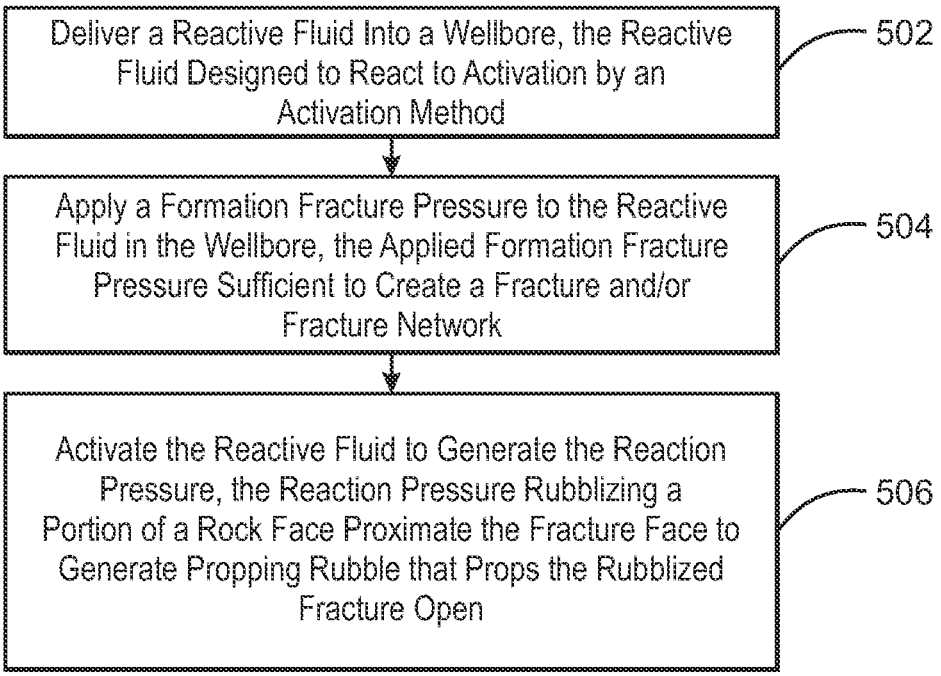
FIG. 5 is a process flow diagram of a method for creating fractures in rock, in accordance with an exemplary embodiment of the present techniques.

FIG. 5 is a process flow diagram of a method 500 for creating fractures in rock, in accordance with an exemplary embodiment of the present techniques. The method 500 may be implemented with a variety of hardware, such as the equipment described with respect to FIGS. 1, 2, and 3.

At block 502, the method 500 includes delivering a reactive fluid into a wellbore, the reactive fluid prepared to react to activation by generating a reaction pressure. In an example, the reaction pressure is an increased pressure as compared to a propping pressure used to prop open the fracture network allowing fluid flow into the fracture network. In an example, the reactive fluid may be at least one of Picatinny Liquid Explosive (PLX), nitromethane, ethylene diamine, triethylene tetramine, ethanolamine, powdered RDX (cyclotrimethylenetrinitramine), powdered octogen (HMX), Astrolite (ammonium nitrate and hydrazine), Astrolite G, aluminum powder, nitromethane, nitromethane—amine mixtures, and nitroglycerin.

The reactive fluid can be activated using a variety of techniques. For example, the reactive fluid can be activated by mixing of fluids, or delivery of solids contained in a fluid to the fracture. An activating fluid may be a second fluid other than the reactive fluid that is added to the reaction site in the fracture network after the reactive fluid. The activating fluid may also be added to the reaction site in the fracture network at the same time as the reactive fluid. The activating fluid may be pre-mixed with the reactive fluid in a way that the resulting reaction is time delayed from the time of mixing.

The reactive fluid may also be activated through electrical activation, electro-magnetic waves, acoustics, or pressure such as steady pressure and/or waves. Additional reaction activation techniques include direct physical impact or mechanical action and heat. Depending on the location and composition of the site intended for reaction, the reactive fluid could be activated by in situ fluids, in situ rock matrix, or by light or optics. Other reactions may be triggered in the reactive fluid after a period of time, through emulsions delivered to the reaction site in the fracture network, or through a combination of emulsions and solids delivered to the reaction site in the fracture network. The reactive fluid may also be activated by a resonant frequency delivered through the ground that is resonated to either a substance, the reactive fluid, or the wellbore sufficiently to activate the reactive fluid. The reactive fluid may also be activated by byproducts of life forms, such as bacteria byproducts, or the byproducts of a separate chemical reaction. The reactive fluid may also be activated using radioactive radiation.

The wellbore in the method 500 may be a lateral wellbore. In an example, the reactive fluid may be activated in a lateral wellbore without reacting in a primary wellbore. The reactive fluid may be activated in the fracture off of the lateral wellbore without reacting in the lateral wellbore.

At block 504, the method 500 includes applying a formation fracture pressure to the reactive fluid in the wellbore, the applied formation fracture pressure sufficient to create a fracture network and deliver the reactive fluid into the created fracture network. At block 506, the method 500 includes activating the reactive fluid to generate the reaction pressure, the reaction pressure rubblizing a portion of a rock face proximate the fracture network to generate propping rubble that props the rubblized fracture network open. While in a sense, a reactive fluid may be added into the wellbore, there may not be any incremental or added pumping pressure. Thus, the pressure used or required to deliver the reactive fluid into the wellbore may be the same pressure used to create the fracture and deliver the reactive fluid into the created fracture. However, in other variations, the pressure may be increased upon the addition of additional fluid, such as reactive fluid. Similarly, the term delivering may also be used as reaction fluid may be delivered rather than always pumped, so long as the reactive fluid reaches the fracture network. Additionally, delivering of reactive fluid may be a spotting or a bullheading pressure that is below formation fracture pressure.

In an example, the method includes reducing a pressure in the wellbore to a target pressure below a wellbore structural integrity range. The pressure valve may be a choke manifold. The choke manifold may be located on a ground-level surface. The choke manifold may be located in a subsurface region. The reaction pressure may increase the flow area of a pore network in the portion of rock of the fracture wall face in the wellbore. In an example, reaction pressure may create new fractures along the wellbore.

In an example, the method 500 includes applying an activating fluid to a reaction site in the fracture network to enable the reactive fluid to react upon activation. The method 500 may also include subsurface bleed off to maintain a target pressure inside the wellbore. The method 500 may also include an activation source for the reactive fluid that may be at least one of a signal sent via a wellbore tubular, a signal sent via an electrically-conductive material attached to the wellbore tubular, a signal sent via a fiber-optic line conveyed via a tubular, a signal sent through a communicative connection within a wall of the tubular, a signal sent via a fluid inside the tubular, a signal sent through a communicative connection inside the wellbore tubular. The activation source for the reactive fluid may also be at least one of a signal sent via a fluid inside the wellbore tubular, a signal sent through a communicative connection inside the wellbore tubular, and a signal sent through a communicative connection inside the annulus between the wellbore and the wellbore tubular. The activation source for the reactive fluid may also be an activation mechanism conveyed to a reaction site in the fracture network by at least one of a jointed pipe, coiled tubing, wireline or electric line (eline), carbon or composite rod material, or tractors. The activation source for the reactive fluid may also include pumping a fluid, mixture, or emulsion into the well or an adjacent well. The activation source for the reactive fluid may also include at least one of pressurizing the wellbore from the surface or subsurface using a pressure vessel, pumping an activation device downhole, pumping a control device downhole to operate a separate in-situ activation device, or providing electromagnetic signals through the subsurface to the reactive fluid. In an example, delivery of reactive fluid into the wellbore and subsequent activation is repeated more than once, and with each repetition, the delivery of reactive fluid may reach fractures of the fracture network further in distance from the wellbore. The repeated reactions may result in larger fracture networks. Further, the repeated reactions can create a range of sizes from proppant created from the reactions. This may be particularly helpful as the fractures of the fracture network may be various sizes. In an example, the initially created proppant may shrink due to repeated reactions further rubblizing the previously created proppant. This range of proppant sizes may help to hold open a larger and irregularly sized fracture network and thereby increase fluid flow from the fracture network.

In an example, the method includes reducing a pressure in the wellbore to a target pressure below a wellbore structural integrity range. The method may include at least one of the reactive fluid and the activation fluid is injected into the well using an inner removable tubular string such as coiled tubing or jointed tubing. In an example, the method includes at least one of the reactive fluid and the activation fluid is primarily isolated from the wellbore by at least one of a packer and a system of packers. In an example, the method may include at least one of the reactive fluid and the activation fluid is injected into at least one of the inner removable tubular string and a surrounding annulus. The method may include at least one of the reactive fluid and the activation fluid is injected into the well using at least a flow path in a concentric tubular string conveyed inside the wellbore. In this example, the concentric tubular string inside the wellbore may be coiled tubing inside coiled tubing. The method may include at least one of the reactive fluid injected into the well using at least a flow path is primarily isolated from the wellbore by at least one of a packer and a system of packers.

Step-by-Step Activation

Figure 6:
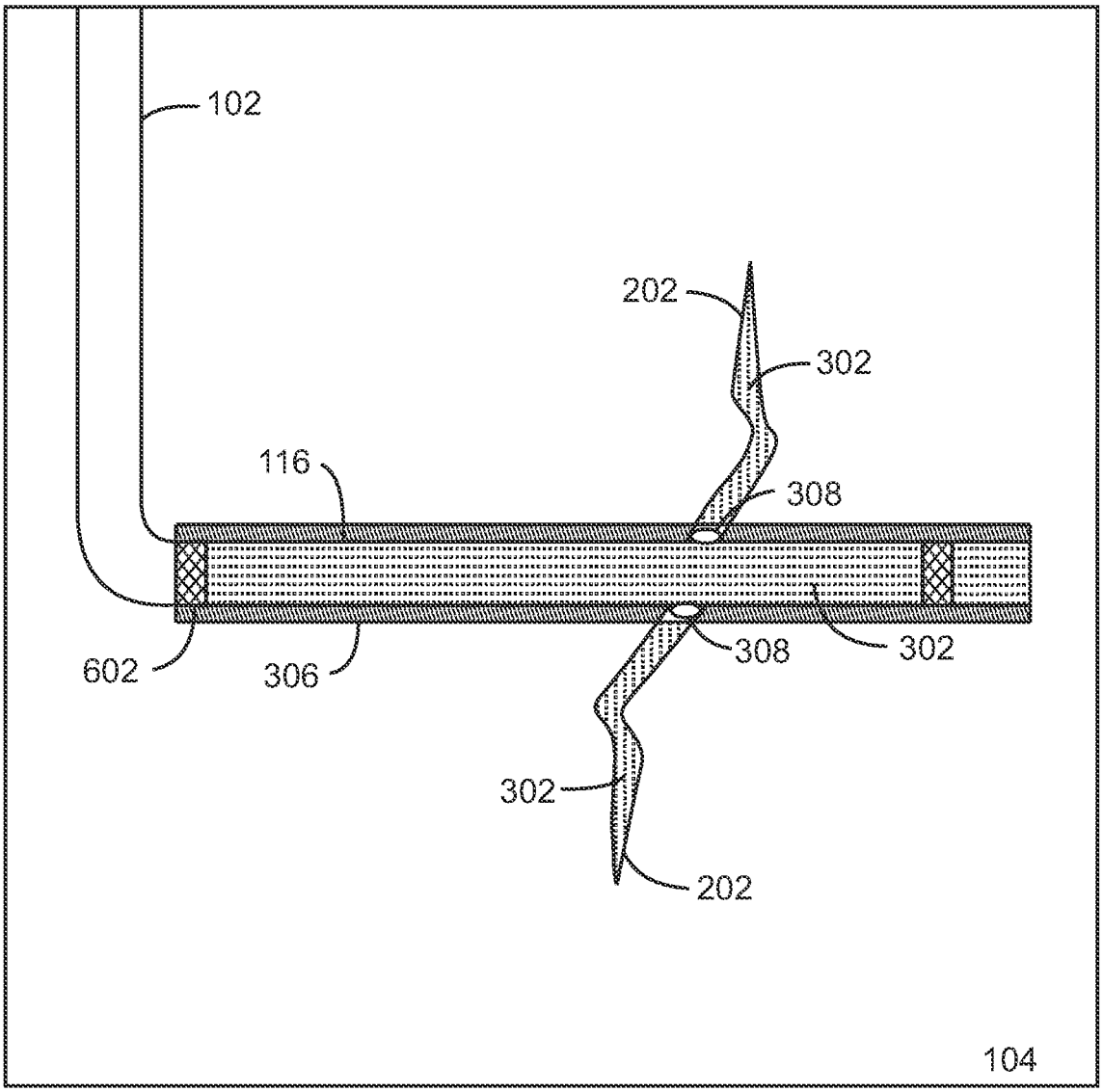
FIG. 6 is a side view of a lateral wellbore and reactive fluid forming a fracture, in accordance with an exemplary embodiment of the present techniques.

FIG. 6 is a side view 600 of a lateral wellbore 202 and reactive fluid forming a fracture 204, in accordance with an exemplary embodiment of the present techniques. Like numbered items are as described with respect to FIG. 1 and FIG. 2.

The present side view 600 contemplates that the lateral wellbore 202 may be one of a number of wellbores off of the primary wellbore of the well 102. Accordingly, a tubular running down the primary wellbore of the well 102 may branch off into the lateral wellbore 202 by use of a fitting 602. The fitting 602 may act as a reinforced channel between the primary wellbore of the well 102 and the lateral wellbore 202. In an example, the fitting 602 may enable fluid flow to and from the lateral wellbore 202.

In an example, the reactive fluid 302 may be delivered into the entire lateral wellbore 202. In another example, the reactive fluid 302 may be delivered into a fracture 204 without being delivered into the entire lateral wellbore 202. The strategic deployment of reactive fluid 302 to particular reaction sites may manage the pressure resulting from reactive fluid 302 activation. The deployment of reactive fluid 302 into an entire lateral wellbore 202 may be used in cases where the reaction takes place in all parts of the lateral wellbore 202. In an example, the reactive fluid 302 may be pumped into the lateral wellbore 202 prior to the fracture 204 being formed. The reactive fluid 302 may also serve as the fluid to commute hydraulic pressure into the lateral wellbore 202 at sufficient levels that a fracture 204 forms in the lateral wellbore 202. Compared to traditional methods of fracing, the ability, in an example, to use a single fluid for fracing and for later use in producing in situ rubble to act as proppant cuts down on the time and expense of a number of intermediate steps in producing a high fluid-flow wellbore.

In an example, the reactive fluid 302 can be a premixed fluid, where all of the chemicals used to react may be in a single fluid. In another example, the reactive fluid 302 can be a non-premixed fluid, where a non-premixed fluid includes separate fluids that are mixed to create a reactive fluid. In this example, the reactive fluid could be constructed downhole by pumping a series of chemicals needed to create a reactive fluid and permitting them to mix subsurface into the desired reactive compound.

In an example, the reactive fluid 302 can be a combination of a reactive fluid with reactive solids in both premixed and non-premixed formats. In an example, the reactive fluid 302 can be an emulsion that converts a portion of the subsurface into a reactive fluid. In an example, the emulsion fluids may contact another fluid to convert into a reactive fluid, or the emulsion fluids may convert into one of the fluids needed in a non-premixed fluid system. In an example, the reactive fluid 302 can be a combination of an emulsion and solids.

The reactive fluid may be a fluid that is capable of converting to a readily reactive state. For example, an injected fluid compound may become readily reactive once heated to near reservoir temperature. In another example, an injected compound may become a readily reactive fluid after encountering reservoir fluids or reservoir matrix material.

In an example, the reactive fluid is a compound that naturally converts from a stable state to a reactive state after a fixed period of time. In this example, the compound may be injected into the fracture, and the conversion may slowly occur such that the resulting fluid becomes reactive only after a certain concentration of reactive particles are present within the fluid. In another example, the reactive fluid is a compound that is converted to a reactive fluid using a catalyst.

The chemistry of the reservoir rocks may also be used in generating the reactive fluid or activating the reactive fluid. In an example, due to the chemically-active nature of reservoir rock materials, it may be possible to establish the initial fracture with a fluid that was designed to compromise or weaken the inter-granular strength of the rock material so that the subsequent elevated pressure reaction process could effectively disaggregate the rock's face into self-generated proppant. An example of this may include clay formations that are sensitive to salinity changes and other formations that are sensitive to various acids. In an example, pretreatment chemicals could also be used to open pore throats and/or bodies. The more open pore throats and bodies may reduce the risk of the reaction quenching because a reactive fluid 302 may be less impeded at it traveled between pores.

Figure 7:
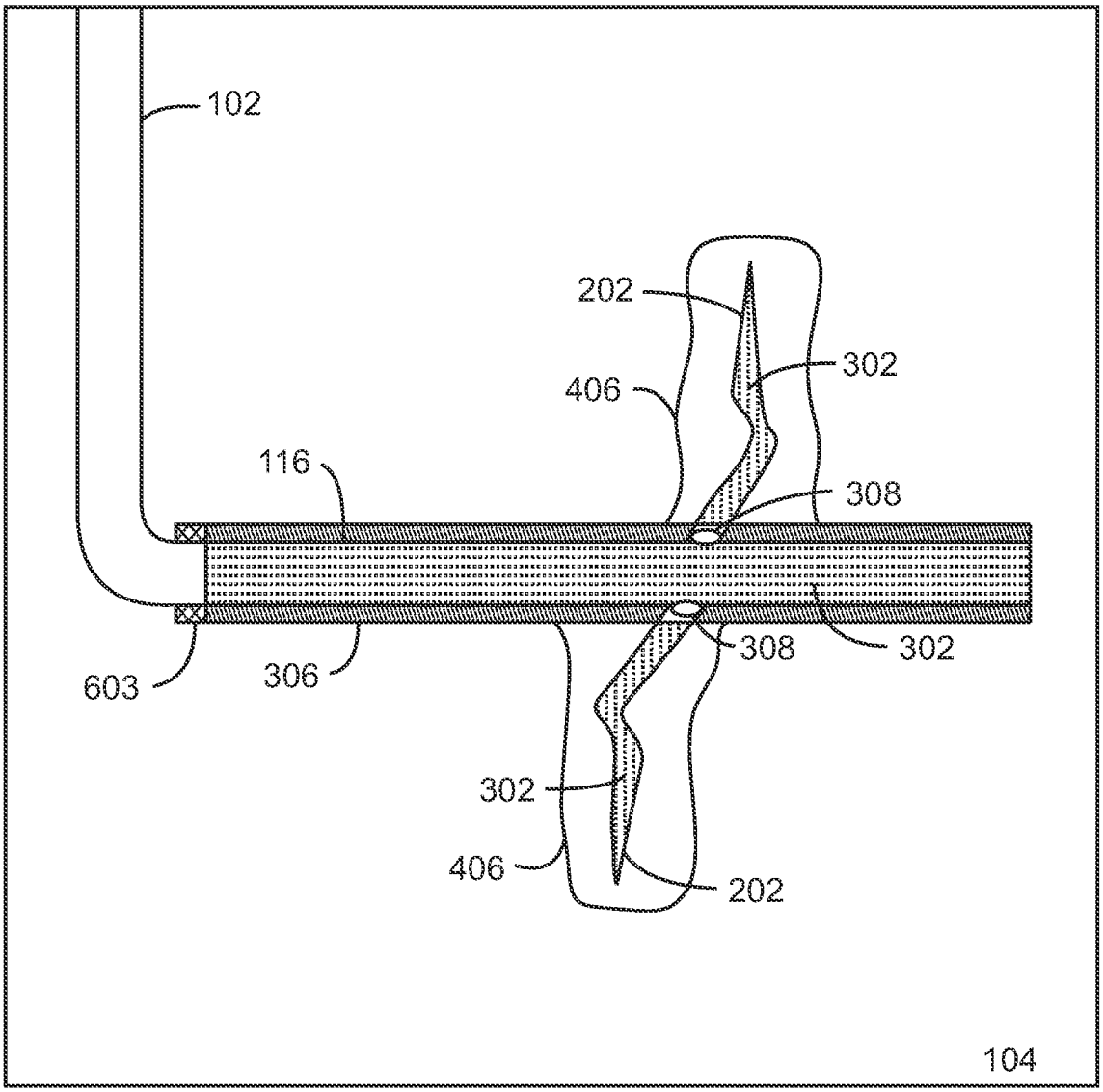
FIG. 7 is a side view of a lateral wellbore and reactive fluid that has dispersed into surrounding pore space of a fracture and lateral wellbore, in accordance with an exemplary embodiment of the present techniques.

FIG. 7 is a side view 700 of a lateral wellbore 202 and reactive fluid 302 that has dispersed into the surrounding pore space of a fracture and lateral wellbore, in accordance with an exemplary embodiment of the present techniques. Like numbered items are as described with respect to FIGS. 1, 2, 3, and 6.

Once reactive fluid 302 has been pumped into the fracture 204, the pumping pressure may be decreased at the surface to allow the reactive fluid 302 to leak off into a leak-off area 406. In an example, if the reactive fluid 302 is disposed exclusively in the fracture 204 and not in the lateral wellbore 202, the leak-off area 406 may be located only in the areas immediately adjacent to the fracture. In another example, if the reactive fluid 302 is dispersed throughout the lateral wellbore 202, the leak-off area 406 may surround the area around the fracture 204 as well as the lateral wellbore 202. In an example, the fitting 602 may act as a one-way barrier to the reactive fluid 302 so that the reactive fluid 302 may enter the lateral wellbore 202 but may not move from the lateral wellbore 202 into the primary wellbore of the well 102. The time allowed from leak-off may be in the range one (1) minute and two (2) days, in the range sixty (60) minutes and one (1) day, in the range between one (1) minute and sixty (60) minutes, in the range between 1 hour to 24 hours, or one (1) day to two (2) days depending on the fluid and the type of system being used.

Figure 8:
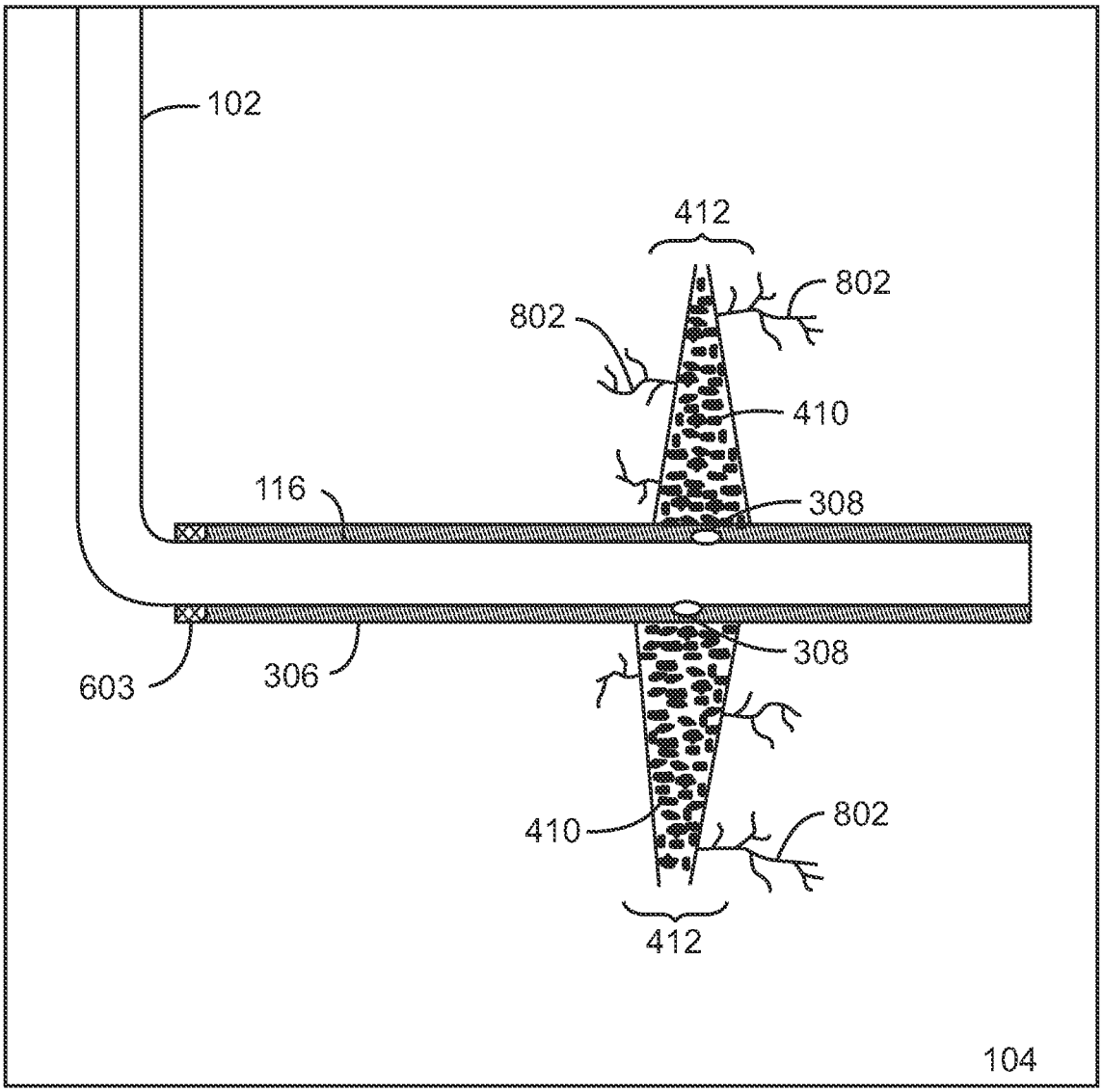
FIG. 8 is a side view of a lateral wellbore showing the expanded fracture resulting from the reaction of the reactive fluid, in accordance with an exemplary embodiment of the present techniques.

FIG. 8 is a side view 800 of a lateral wellbore 202 showing the expanded fracture 412 resulting from the reaction of the reactive fluid 302, in accordance with an exemplary embodiment of the present techniques. Like numbered items are as described with respect to FIGS. 1, 2, 4, and 6.

Upon activation, the reactive fluid 302 may rubblize the fracture-face rock and material from the leak-off area 406. The resulting rubble 410 may remain inside the expanded fracture 412 as pressure is released through further leak-off into the surrounding rock and bleed-off either at the surface or through subsurface valves and chokes. In an example, a pressure valve at the surface controls the pressure during and immediately following the reaction of the reactive fluid 302. The target pressure may be a pressure that is set and maintained by the pressure valve strategically releasing either fluid or gas, or both, from inside the primary wellbore of the well 102 or lateral wellbore 202. The target pressure may be allowed, by the control of the pressure valve, to be high enough to create complex fractures 804 inside the expanded fracture 412. This may increase the fluid flow and allow for greater access to the resources. The target pressure may be maintained by the pressure valve such that the downhole pressure is allowed to build up to a high enough level so that new fractures 802 form off of the lateral wellbore 202. In an example, these new fractures 802 may present future reaction sites for reactive fluid to flow, leak off, and react in the case that further poration is desirable in the area of the lateral wellbore 202.

In an example, the target pressure may be maintained as lower than a collapse pressure or any pressure that may threaten the structural integrity of the wellbore of the well 102, the lateral wellbore 202 or any other component experiencing the pressure of the reacting reactive fluid 302.

A number of activation approaches may be used. While a number of activation approaches are listed, one or more may be used, either alone or in combination with other approaches both listed and unlisted here.

In an example, the reactive fluid 302 may be activated by at least one of mixing fluids, delivering solids contained in a fluid to the fracture, or using electricity, electro-magnetic waves, acoustics, steady pressure, pressure waves, impact or mechanical action, or heat. The reactive fluid 302 may also be activated by at least one of in situ fluids, in situ rock matrix, light or optics, time, e.g., activates 48 hours after pumping, emulsions, or a combination of emulsions and solids. The reactive fluid 302 may also be activated by at least one of a resonant frequency of the fracture or the reactive fluid, byproducts from life forms such as bacterial by-products, a separate chemical reaction, or radioactive radiation.

In another example, the reactive fluid 302 may be activated by an activation source. The activation source may be, for example, a signal, media, activation equipment delivered to a reaction site in the fracture network, or equipment that is part of the pumping mechanism. In an example, the activation source may be a signal, media, or piece of equipment that operates as part of a separate system that activates the reactive fluid. In an example, the activation source may be at least one of signals sent via the wellbore tubulars and/or cement, signals sent via electrically-conductive wire/material strapped to the tubular, signals sent via fiber-optics strapped to the tubular, signals sent through communication means within the tubular's body (e.g., wall), and signals sent via the fluids contained in the tubulars. In a further example, the activation source may make use of at least one of electrically-conductive material/wire or fiber optic line inside the wellbore, downhole tools delivered by a conveyance means, jointed pipe, coiled tubing, wireline or eline, carbon or composite rod material, or tractors.

In an example, the reactive fluid 302 may be activated by pumping a fluid and/or a fluid plus solids mixture and/or emulsions into a well or an adjacent well. In another example, the reactive fluid 302 may be activated by pressurizing the wellbore from the surface or subsurface using a pressure vessel. Moreover, in other examples, the reactive fluid 302 may be activated by pumping an activation device downhole, pumping a device downhole that operates a separate in-situ activation device, using a separate wellbore and/or its fractures, or using signals sent through the earth.

Figure 9:
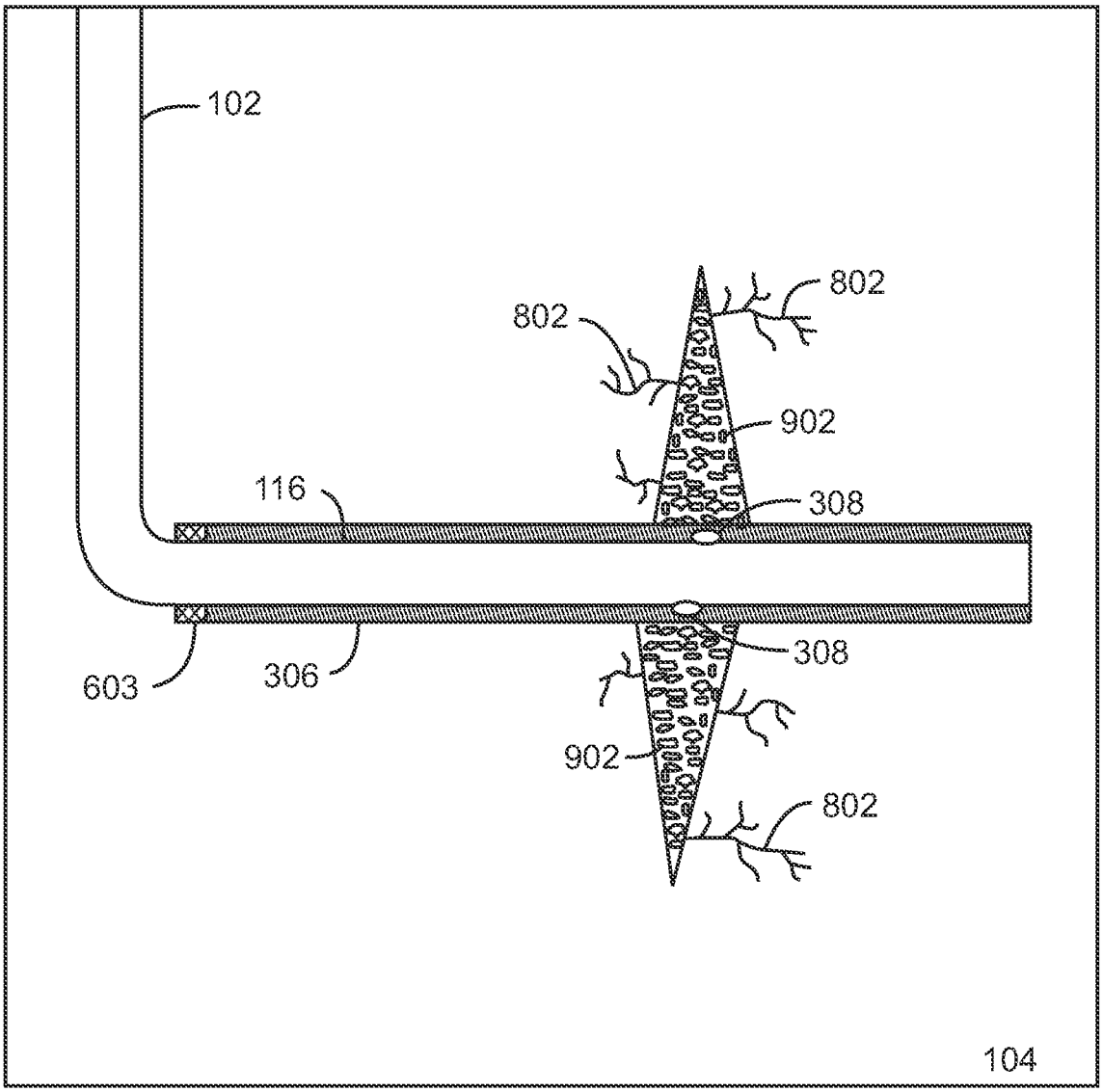
FIG. 9 is a side view of a lateral wellbore showing the fracture propped open by rubble created from the reaction of the reactive fluid in the fracture, in accordance with an exemplary embodiment of the present techniques.

FIG. 9 is a side view 900 of a lateral wellbore 202 showing the fracture propped open by rubble 410 created from the reaction of the reactive fluid 302 in the fracture 204, in accordance with an exemplary embodiment of the present techniques. Like numbered items are as described with respect to FIGS. 1, 6, and 8.

As pressure is released from the lateral wellbore 202, the wall of the fracture may be propped open by the rubble 410 created from the fracture-face rock. In this way, the rubble 410 serves as propping rubble 902 to increase fluid flow channels in the expanded fracture 412, thus eliminating the use of external proppant within the fracture. While the propping rubble 902 may remain in the fracture, the space between rubble particles may allow much greater fluid flow compared to the earlier states of the fracture.

A number of additional examples may also be used as a way of creating in situ proppant in order to hold an expanded fracture open.

Example 1

In this example, a system or method starts with two separate fluids, e.g., Fluid 1 and Fluid 2, that aggressively react as contacted. Fluid 1 is pumped into a set of perforations above fracing pressure such that a fracture forms in a lateral wellbore. Fluid 1 may be pumped until the desired fracture length and size is achieved. The pump may then stop, and the fluid may be allowed to leak-off or partially leak-off, over time, into the rock's porosity so that the reactive fluid saturates the rock a fixed distance from the rock-face. This distance may be correlated to the time and porosity and, in some cases, may be around −¼ inch absorption from the fracture. During leak-off, the fracture may or may not close.

A second pump may be used to deliver Fluid 2 to react aggressively with Fluid 1. In an example, Fluid 2 may be pumped with a physical wiper plug between the fluids or a catalyst buffer pill in order to keep the two fluids separate in the wellbore. The second pump may deliver Fluid 2 at a rate that enables the reaction to take place in a controlled fashion. As Fluid 2 encounters Fluid 1, the reaction takes place, thereby breaking off some of the rock fabric on the fracture wall face. As rock breaks off, more of fracture-face is exposed to the fluid, thereby allowing the fluid to further saturate into the matrix of the exposed fracture-face. This additional saturation enables the reaction and resulting pressure wave to go deeper and rubblize more of the porous rock matrix. In this example, the reaction increases the pressure within the fracture/wellbore which opens-up the crack width so the rubblized material can accumulate in the wide fracing opening. In this example, the rock matrix rubble becomes the proppant for the fracture. The rate that the reactive fluid is pumped into the crack can control the amount of reactant there is available at the fracture wall face. This fluid delivery rate management may be used to manage the well pressure for integrity of the well and in order to perpetuate reaction. In this example, the second pump may continue to pump Fluid 2 in a controlled fashion so the reaction continues to progress farther and farther into the existing fracture created by, and saturated by, Fluid 1. The result of this example may be a large, conductive fracture that is propped open with its own material and was created without the use of a large and expensive fracing fleet. Accordingly, this example provides a technique resulting in no purchased proppant and negligible fluid use.

Example 2

In this example, a single reactive fluid may be used. The single fluid may be highly stable under normal oilfield conditions but highly reactive as a sufficient threshold energy is applied. The fluid may be similar to RDX and HMX materials used in perforating charge in a fluid form. The fluid may be pumped into a set of perforations above fracing pressure such that a fracture forms. The fluid may be pumped until the desired fracture length and size is achieved. After pumping is stopped, fluid leak-off (or partial leak-off) can begin into the rock's porosity. The fluid may saturate the rock a fixed distance from the rock-face, e.g., about ¼ inch. The fracture may or may not close all the way as the fluid leaks off.

If there is sufficient pressure management equipment on the surface, another fluid may be pumped that carries nanoparticles, potentially with a dissolvable outer membrane, in a benign catalyst fluid. The nanoparticles contain a pay-load that activates with the reactive fluid in the fracture to initiate the reaction of the fluid itself. In this example, the reaction may be aided by the catalyst if needed. For the case of the membrane-covered nanoparticle, after the nanoparticle mixture is pumped into the fracture, the membrane wall dissolves, releases the payload, and activates the reactive mixture contained within the fracture and saturated into the walls of the fracture-face rock's porosity.

In this case, the reactive fracturing fluid may be premixed so no mixing is required downhole for the reaction to occur. In this example, there is no need to wait for mixing of two fluids to take place or to create an environment that facilitates effective mixing. The result of this example may be a large, conductive fracture that is propped open with its own material and was created without the use of a large and expensive fracing fleet. Accordingly, this example provides a technique resulting in no purchased proppant and negligible fluid use.

Example 3

In this example, a combination for a fracturing approach could include a reactant, combined with an activation approach, delivered by an activation method as discussed herein. In the example where a compound that is injected is not readily reactive, the fluid may be converted to a readily reactive compound for activation by an external source.

Example 4

In this example a method of creates fractures in rock, including delivering a reactive fluid into a wellbore, the reactive fluid prepared to react to activation by generating a reaction pressure. Further, in this example a formation fracture pressure is applied to the reactive fluid in the wellbore, the applied formation fracture pressure being sufficient to create a fracture network and deliver the reactive fluid into the created fracture network. The method may also include activating the reactive fluid to generate the reaction pressure, the reaction pressure rubblizing a portion of a rock face proximate the fracture network to generate propping rubble that props the rubblized fracture network open. The pressure may be reduced in the wellbore to a target pressure below a wellbore structural integrity range.

It should be understood that the preceding is merely a detailed description of specific embodiments of this invention and that numerous changes, modifications, and alternatives to the disclosed embodiments can be made in accordance with the disclosure here without departing from the scope of the invention. Rather, the scope of the invention is to be determined only by the appended claims and their equivalents.

What is claimed is:

1. A method of creating fractures in a subsurface formation, comprising:

delivering a reactive fluid into a wellbore without proppant;

stopping delivering and allowing a portion of the reactive fluid to leak off into a leak-off area adjacent to a fracture in the subsurface, wherein the reactive fluid displaces existing hydrocarbons;

applying a formation fracture pressure to the reactive fluid, the applied formation fracture pressure is sufficient to create a fracture network in a formation with the reactive fluid delivered into the created fracture network; and activating the reactive fluid to generate a reaction pressure resulting from either detonation or deflagration, the reaction pressure rubblizing a portion of a rock face proximate the fracture network to generate propping rubble that props the rubblized fracture network open.

2. The method of claim 1, comprising applying an activating fluid to a reaction site in the fracture network to enable the reactive fluid to react to activation.

3. The method of claim 1, wherein the reactive fluid comprises at least one of Picatinny Liquid Explosive (PLX), ethylene diamine, triethylene tetramine, ethanolamine, powdered RDX (cyclotrimethylenetrinitramine), powdered octogen (HMX), Astrolite (ammonium nitrate and hydrazine), Astrolite G, aluminum powder, nitromethane, nitromethane with amine mixtures, nitroglycerin, aluminum reactive material, polytetrafluoroethylene, and polytetrafluoroethylene/aluminum.

4. The method of claim 1, wherein the reactive fluid is activated by at least one of mixing fluids, solids contained in the reactive fluid that is delivered to the fracture, electrical activation, electro-magnetic waves, acoustics, pressure, impact or mechanical action, heat, in situ fluids, using reactive qualities in an in situ rock matrix, light or optics, a reactive fluid reaction that occurs after a period of time sufficient for chemistry evolution and change in the reactive fluid, emulsions, a combination of emulsions and solids, a resonant frequency of a substance or the reactive fluid or the wellbore, pH, using byproducts from life forms, using a separate chemical reaction other than the reaction by the reactive fluid, or radioactive radiation.

5. The method of claim 1, wherein the wellbore comprises a lateral wellbore.

6. The method of claim 5, wherein the reactive fluid is activated in the lateral wellbore without reacting in a primary wellbore.

7. The method of claim 5, wherein the reactive fluid is activated in the fracture network off of the lateral wellbore without reacting in the lateral wellbore.

8. The method of claim 1, wherein an activation source comprises at least one of a signal sent via a wellbore tubular, a signal sent via an electrically-conductive material attached to the wellbore tubular, a signal sent via a fiber-optic line conveyed via a tubular, a signal sent through a communicative connection within a wall of the tubular, a signal sent via a fluid inside the tubular, a signal sent through a communicative connection inside the wellbore tubular, a signal sent through a communicative connection inside an annulus between the wellbore and the wellbore tubular; or wherein the activation source comprises at least one of pumping a fluid or a mixture or an emulsion into the well or an adjacent wellbore, pressurizing the wellbore from a surface using a pressure vessel, pressurizing the wellbore from a subsurface using a pressure vessel, pumping an activation device downhole, pumping a control device downhole to operate a separate in-situ activation device, or providing an electromagnetic signal through the subsurface to the reactive fluid.

9. The method of claim 1, further comprising controlling a pressure valve, wherein the pressure valve comprises a choke manifold.

10. The method of claim 9, wherein the choke manifold is located on a ground-level surface.

11. The method of claim 9, wherein the choke manifold is located in a subsurface region.

12. The method of claim 1, wherein the rubblization of the portion of the rock face increases a flow area of a pore network in the portion of the rock face of the fracture wall face in the wellbore.

13. The method of claim 1, wherein the reaction pressure generates new fractures along the wellbore.

14. The method of claim 1, comprising subsurface bleed off to maintain a target pressure inside the wellbore.

15. The method of claim 1, wherein the reactive fluid is activated after the reactive fluid has absorbed into the portion of the rock face.

16. The method of claim 1, wherein the pressure in the wellbore is reduced to a target pressure using surface bleed off through a controlled pressure valve.

17. The method of claim 1, wherein delivery of reactive fluid into the wellbore and subsequent activation is repeated more than once, with each repetition delivery of reactive fluid reaching fractures of the fracture network further in distance from the wellbore.

18. The method of claim 1, comprising reducing a pressure in the wellbore to a target pressure below a wellbore structural integrity range.

19. The method of claim 1, wherein at least one of the reactive fluid and an activation fluid is injected into the well using an inner removable tubular string, wherein both of the reactive fluid and the activation fluid include at least one of additional solids and no additional solids.

20. The method of claim 19, wherein at least one of the reactive fluid and the activation fluid is primarily isolated from the wellbore by at least one of a packer and a system of packers.

21. The method of claim 19, wherein at least one of the reactive fluid and the activation fluid is injected into at least one of the inner removable tubular string and a surrounding annulus.

22. The method of claim 1, wherein at least one of the reactive fluid and an activation fluid is injected into the well using at least a flow path in a concentric tubular string conveyed inside the wellbore.

23. The method of claim 22, wherein at least one of the reactive fluid injected into the well using at least a flow path is primarily isolated from the wellbore by at least one of a packer and a system of packers.

24. A system for creating fractures in rock, comprising:

a pump to deliver a reactive fluid into a wellbore without proppant, a portion of the reactive fluid leaking off into a leak-off area adjacent to a fracture in the rock after the pump is stopped, wherein the reactive fluid displaces existing hydrocarbons;

the pump to apply a formation fracture pressure to the reactive fluid in the wellbore, the formation fracture pressure sufficient to create a fracture network in a formation with the reactive fluid delivered into the created fracture network; and an activation source to activate the reactive fluid to generate a reaction pressure resulting from either detonation or deflagration, the reaction pressure rubblizing the portion of the rock face proximate the fracture network to generate propping rubble that props the fracture network open.

* * * * *